United States Patent [19]

Singer et al.

[11] Patent Number: 5,019,281

[45] Date of Patent: May 28, 1991

[54] HYDROPHILIC SOFTHAND AGENCY FOR FIBROUS MATERIALS AND USE THEREOF

[75] Inventors: Heinrich Singer, Horgau; Gabriele Köppel, Meitingen, both of Fed. Rep. of Germany

[73] Assignee: Ciba-Geigy Corporation, Ardsley, N.Y.

[21] Appl. No.: 450,134

[22] Filed: Dec. 12, 1989

[51] Int. Cl.[5] ..... D06M 13/46; D06M 15/22

[52] U.S. Cl. ..... 252/8.8; 252/8.6; 252/8.9; 252/545; 252/547; 260/404.5; 548/354

[58] Field of Search ..... 252/8.8, 8.9

[56] References Cited

U.S. PATENT DOCUMENTS

| | | | |
|---|---|---|---|
| 3,565,840 | 2/1971 | Mirabile et al. | 106/8 |
| 3,583,912 | 6/1971 | Clark | 252/8.8 |
| 3,920,563 | 11/1975 | Wixon | 252/8.6 |
| 3,954,634 | 5/1976 | Monson et al. | 252/8.75 |
| 4,211,815 | 7/1980 | Deiner | 428/290 |
| 4,264,516 | 4/1981 | Hiestand | 252/8.8 |
| 4,277,350 | 7/1981 | Minegishi et al. | 252/8.8 |
| 4,456,554 | 6/1984 | Walz et al. | 260/403 |
| 4,767,547 | 8/1988 | Straathof et al. | 252/8.8 |
| 4,830,771 | 5/1989 | Ruback et al. | 252/8.8 |
| 4,851,141 | 7/1989 | Demangeon et al. | 252/8.75 |
| 4,908,160 | 3/1990 | Thacker | 8/127.1 |
| 4,948,520 | 8/1990 | Sasaki | 252/8.8 |
| 4,960,526 | 10/1990 | Puentes-Bravo et al. | 252/8.8 |

FOREIGN PATENT DOCUMENTS

| | | |
|---|---|---|
| 3437321 | 4/1986 | Fed. Rep. of Germany . |
| 55-112377 | 8/1980 | Japan . |
| 55-116877 | 9/1980 | Japan . |

*Primary Examiner*—A. Lionel Clingman

*Attorney, Agent, or Firm*—George R. Dohmann; Edward McC. Roberts

[57] ABSTRACT

The present invention relates to hydrophilic softhand agents for fibrous materials which besides customary emulsifiers, known ingredients and water contain a water-soluble ammonium salt with at least one fatty acid radical as component (1), at least one quaternary ammonium compound other than component (1) with at least one long-chain alkyl radical as component (2) and conventionally dispersed polyethylene wax as component (3). The use of these softhand agents for treating fibrous materials, in particular textiles, is also described.

The present hydrophilic softhand agents are notable for combining good to very good hydrophilicity and a pleasantly soft, fleecy/full softhand with virtually unimpaired whiteness of the treated materials and extremely good storage and temperature stability.

14 Claims, No Drawings

HYDROPHILIC SOFTHAND AGENCY FOR FIBROUS MATERIALS AND USE THEREOF

The present invention relates to a hydrophilic softhand agent for fibrous materials which, besides customary emulsifiers, known ingredients and water, contains a water-soluble ammonium salt with at least one fatty acid radical, at least one further quaternary compound having a long-chain alkyl radical, and conventionally dispersed polyethylene wax. The present invention also relates to the use of this softhand agent.

It has long been known that polyethylene dispersions are very suitable for improving textile hand and in particular sewability. It is also known to use fatty acid alkanolamides for obtaining a soft, smooth hand. Finally, it is well known that quaternary ammonium compounds are likewise suitable for use as hand finish components for fibrous materials, in particular textiles. This last group of compounds has the additional advantage of going onto the fiber, making them very useful in fabric conditioners. The disadvantage of all these compounds, however, is that they only confer unsatisfactory hydrophilicity on the materials treated therewith.

For certain goods, in particular terry towelling, especially cotton terry towelling, it is necessary to confer on the treated materials not only a pleasant soft, full and fleecy hand but also good to very good absorbence, i.e. hydrophilicity, so that the material may feel as dry as possible in use.

DE-A-2,833,172 corresponding to U.S. Pat. No. 4,264,516 discloses water-soluble, quaternary ammonium salts with at least one fatty acid radical for use as soft hand agents, and the use thereof for the antistatic and hand-influencing finishing of organic fiber materials. This known finish does provide good hydrophilicity, but the hand is unsatisfactory and, above all, the finished material shows considerable yellowing. It is an object of the present invention to provide agents which are capable not only of supplying a pleasantly soft, full and fleecy hand but also of conferring good to very good absorbence (hydrophilicity) on the treated material without yellowing while having satisfactory shelf life characteristics.

This object is achieved according to the invention by the provision of hydrophilic softhand agents which combine all the desired properties and in addition can be prepared in an inexpensive manner if they have the composition described in more detail in claim 1.

Subclaims 2 to 8 are directed to further details of the hydrophilic softhand agents, and claims 9 and 10 to the use thereof.

The essential component of the hydrophilic softhand agent according to the invention is component (1). Its compounds are mostly known from DE-A-2,833,172 corresponding to U.S. Pat. No. 4,264,516. Similarly the preparation thereof is known in principle from this reference and can be effected in the manner described therein. As component (1) are used exclusively compounds quaternized with a di-$C_1$–$C_2$-alkyl ester of a $C_1$–$C_2$-alkylphosphonic acid, although the alkyl radical of 9 to 24 carbon atoms of component (1) may also be unsaturated to a minor extent (to less than 50%). Particularly suitable components (1) are those of the formula (1)

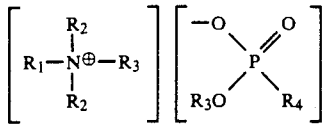

(1)

where R1 is the radical

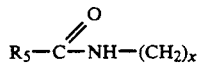

where $R_5$ is saturated $C_1$–$C_{22}$-alkyl, in particular $C_{16}$–$C_{22}$-alkyl, of which up to 25% may be corresponding unsaturated radicals, and x is from 2 to 4, in particular 3, $R_2$ is $C_1$–$C_4$-alkyl, in particular $C_1$–$C_2$-alkyl, and $R_3$ and $R_4$ are each independently of the other $C_1$–$C_2$-alkyl, in particular $CH_3$.

Components (1) are present in the softhand agents in amounts of 2 to 10, in particular 2 to 6, % by weight.

Component (2) is at least one further quaternary ammonium compound which is different from component (1) and has at least one long-chain, saturated and/or unsaturated alkyl. These compounds are generally known, having as the long-chain alkyl at least one saturated and/or unsaturated alkyl of at least 12, in particular 16 to 24, carbon atoms.

Examples are octadecyloxymethylpyridinium chloride and stearylamidomethylpyridinium chloride. But particularly suitable components (2) are quaternary imidazolinium derivatives and quaternary ammonium compounds in the narrower sense. Examples of particularly suitable compounds are the following:

1-stearamidoethyl-2-stearyl-3-methylimidazolinium methosulfate (component 2a), 1-methyl-2-tallowamidoethylimidazolinium methosulfate (component 2b), 1-hydroxyethyl-2-heptadecenylimidazolinium ethosulfate (component 2c), dimethyldistearylammonium chloride (component 2d), di(isopropyl oleate)dimethylammonium ethosulfate (component 2e1) or methosulfate (component (2e2), dicocoalkyldimethylammonium chloride (component 2f), dioleylimidazolinium methosulfate (component 2g) and stearamidopropyltrimethylammonium methosulfate (component 2h).

The amounts of component (2) used are 1 to 13, in particular 2 to 7, % by weight, based on the hydrophilic softhand agent.

Ingredient (3), namely the emulsifiable polyethylene (wax), is known and described in detail in the prior art (DE-C-2,359,966, DE-A-2,824,716 and DE-A-1,925,993). As a general rule, the emulsifiable polyethylene is a polyethylene with functional groups, in particular COOH groups, which may be partly esterified. These functional groups are introduced by oxidizing polyethylene. However, it is also possible to obtain the functionality by copolymerizing ethylene with, for example, acrylic acid. The emulsifiable polyethylene has a density of at least 0.92 g/cm$^3$ at 20° C., an acid number of 5 to 115 and a saponification number of 15 to 150. Particular preference is given to those hydrophilic softhand agents according to the invention which contain emulsifiable polyethylenes having a density at 20° C. of 0.95 to 1.05 g/cm$^3$, an acid number of 10 to 60, and a saponification number of 15 to 80. Commercially, this material is in general available in the form of flakes, pastilles and the like. Component (3), i.e. polyethylene wax in dispersed form, is used in the hydrophilic softhand agent in an amount of from 2 to 10, in particular from 3 to 8, % by weight, based on the softhand agent (calculated as polyethylene wax).

The polyethylene wax is used in the form of 20 to 35% strength aqueous dispersions. Their preparation requires various emulsifiers. These emulsifiers can have a positive effect on the softhand effect of the hydrophilic softhand agents. In addition to the above-described components (1), (2) and (3) and water, the hydrophilic softhand agents according to the invention may contain emulsifiers and further known ingredients.

The use of emulsifiers is advisable from case to case if relatively small amounts of components (1) and in particular (2) are used or if increased demands are made on the compatibility with other finishes, for example fluorescent brightening agents. The emulsifiers used in this case are known nonionic emulsifiers and/or cationic emulsifiers other than (1) or (2).

The skilled worker knows the ethoxylated fatty alcohols, fatty amides, fatty acids and alkylphenols and fatty amines or salts thereof, or the usable fatty amine salts, for example, and will not have any problems with picking appropriate compounds. The amount of additional emulsifier used must be adapted to the particular use.

Further known ingredients are in particular organopolysiloxanes. In addition to the known dialkylpolysiloxanes it is possible to use in particular hydrophilizing silicones. Their addition makes the hand even softer and more pleasant, and also has a favorable effect on the hydrophilicity. The amount of organopolysiloxane used is 0.5 to 7, in particular 1.5 to 5, % by weight, based on hydrophilic softhand agent. The usable hydrophilizing organopolysiloxanes are likewise known to the person skilled in the art. They are in general dimethylpolysiloxanes which contain incorporated epoxy groups (a) and/or polyethoxy or polypropoxy or polyethoxy/propoxy groups (b). Of these, those organopolysiloxanes which contain groups (a) and (b) in the same molecule are particularly suitable.

DE-A-3,437,321 describes fatty acid dialkanolamides as ingredients of softhand agent formulations. These compounds may also be used here. Concerning the use of these compounds, the prior art is incorporated herein by reference. These fatty acid dialkanolamides (fatty acid radical of 16–22 carbon atoms) are used in amounts of 1 to 10, in particular 4 to 8, % by weight, based on the hydrophilic softhand agent.

Further known ingredients for possible use in the preparation of the hydrophilic softhand agents, for example paraffin emulsions or the condensation products known from DE-C-2,318,906 are known to the skilled worker and do not require any further explanation.

The softhand agents according to the invention are prepared by mixing together the ingredients, preferably at a slightly elevated temperature. To improve the metal salt resistance the pH is at the same time adjusted with inorganic acids, for example hydrochloric acid or alternatively with monobasic or dibasic organic acids, such as acetic acid, maleic acid or in particular glycolic acid, to 3–7, in particular 3.5–6.

The hydrophilic softhand agents obtained are used for the softening and simultaneously hydrophilizing finishing of fiber materials of any kind, in particular terry towelling, especially cotton terry towelling. Besides, also, any other textile which in use is suspected to show moisture-absorbing, in particular perspiration-absorbing, properties, such as shirt poplin and in particular bedlinen, is advantageously finished with the present agents.

To this end, the textile is treated with a liquor which contains 15 to 80 g/l, in particular 20 to 60 g/l, of the hydrophilic softhand agent, based on a dispersion having a solids content of in total about 20% by weight, in a conventional manner, which leaves an add-on on the fiber material of about 0.2 to 3% by weight of solid substance. Besides being applied by the known padding techniques, the softhand agents according to the invention may advantageously also be applied by the exhaust method whereby, depending on the add-on requirement, about 1 to 6%, in particular 2 to 4.5%, on weight of fiber (based on the softhand agent dispersion) are applied. The finish is finalized by conventional drying and possibly a brief postcondensation.

The present invention goes a long way to meet a long-felt want for a stable softhand agent which besides conferring a soft, full and fleecy hand also imparts good to very good absorbence, i.e. hydrophilicity. It was also necessary that this combination product should not yellow leaving the whiteness substantially unimpaired, and should in particular be inexpensive to manufacture, a significant consideration for textile finishes. The present hydrophilic softhand agent combines all these positive properties, and therefore is widely usable.

The whiteness is determined by a formula developed by GANZ (cf. R. G. Griesser, Textileveredelung 18 (1983), No. 5, pages 157 to 162). A suitable instrument for carrying out these determination has proved to be the ELREPHO 2000 spectrophotometer for reflectance measurements from Datacolor.

The present invention will now be explained in more detail with reference to the following Examples, where parts and %ages are by weight.

EXAMPLE 1

A) Preparation of Component (1)

A four-necked flask equipped with a stirrer, a thermometer, a dropping vessel and a stillhead is charged with 284 g of technical grade stearic acid, and the contents are heated to 100° C. under nitrogen with moderate stirring. 160 g of diethylaminopropylamine are then added dropwise at a sufficiently slow rate that the temperature does not exceed 120° C. The contents are then heated up and stirred at 130° C. for 1 hour and at 150° C. for a further hour. The temperature is then raised to 180° C. for a further 3 hours of stirring. The reaction has ended when the acid number is below 10.

The contents are then cooled down to 100° C., and 136 g of dimethyl methanephosphonate are added dropwise in such a way that the temperature again does not exceed 120° C. Thereafter the temperature is carefully raised to 130° C. and kept at that for 2 hours with stirring. The N,N-diethyl-N-methyl-N-(stearylamidopropyl)ammonium monomethyl methanephosphonate obtained is filtered hot. After cooling, a pastelike product is obtained.

B) Preparation of the Hydrophilic Softhand Agent (1) In a 2-liter three-necked flask equipped with a thermometer, a stirrer and a reflux condenser, 633 g of water are heated to 60° C., 48 g of component (1) prepared as described above are then added, followed by 30 g of component (2e1) and 20 g of dicocoalkyldimethylammonium chloride, and the mixture is stirred at a temperature of 70° to 75° C. at a moderate speed for 1 hour. 16.7 g of 60% strength acetic acid and 2 g of sodium chlorite are then stirred in, which adjust the pH to 3.5–4.5, and the mixture is then kept at the temperature mentioned until all the oxidizing agent has disappeared. Finally, 250 g of a 30% strength nonionic polyethylene wax dispersion (about 20%, based on polyethylene wax, of ethoxylated alcohols as emulsifier; emulsifiable polyethylene having a density of 0.96 g/cm$^3$, acid number about 25 and saponification number about 45) are added with moderate stirring, and the mixture is cooled down to 30° C. and discharged through a filter. The result obtained is a storable (for at least 1 year), hydrophilic softhand agent which can even be exposed to temperatures of 50° C. or more or temperatures below freezing (down to −15° C.) without impairment.

(2) In the same way as product (B1), except that component (2e1) is replaced by the same amount of component (2b).

(3) In the same way as product (B1), except that component (2e1) is replaced by the same amount of component (2g).

(4) A prior art softhand agent formulation is prepared by replacing component (1) present in product (B1) by the same amount of the fatty acid diethanolamide prepared as described in Example 2 of DE-A 3,437,321.

(5) For comparison, the same procedure as for product (B1) was adopted, except that component (1) was left out and replaced by a correspondingly larger amount of component (2e1).

Products (B1) to (B5) were tested in respect of stability and gave the following results:

| Products | | Storage at 20° C. Stable for | Appearance after storage for 48 hours at +60° C. | Appearance after storage for 48 hours at −15° C. |
|---|---|---|---|---|
| B1 | according to the invention | at least 1 year | unchanged dispersion | unchanged dispersion |
| B2 | according to the invention | at least 1 year | unchanged dispersion | unchanged dispersion |
| B3 | according to the invention | at least 1 year | unchanged dispersion | unchanged dispersion |
| B4 | (Prior art) | at least 1 year | pastyness, precipitates | pastyness, precipitates |
| B5 | (Comparison) | a short period only | pastyness | pastyness |

C) Use of Products (B1) to (B5)

Heavyweight cotton terry towelling (410 g/m$^2$) is finished with 40 g/l of the softhand agents (B1) to (B5) prepared as described above, by dipping into the liquor, squeezing off to 100% pickup and heat treatment at 110° C. (20 minutes) and 190° C. (1 minute). The finished material has the following features:

| Product | | Hand | GANZ | whiteness | Hydrophilicity |
|---|---|---|---|---|---|
| B1 | according to the invention | +++ | 110° C. | 225 | +++ |
| | | | 190° C. | 172 | |
| B2 | according to the invention | +++ | 110° C. | 226 | + |
| | | | 190° C. | 170 | |
| B3 | according to the invention | +++ | 110° C. | 224 | ++ |
| | | | 190° C. | 169 | |
| B4 (Prior art) | | ++ | 110° C. | 220 | − |
| | | | 190° C. | 169 | |
| B5 (Comparison) | | ++ | 110° C. | 215 | − |
| | | | 190° C. | 160 | |
| untreated | | − | 110° C. | 228 | − |
| | | | 190° C. | 188 | |

Legend
Hand +++ = very soft, dry, fleecy/full hand
Hand ++ = softer, somewhat drier, fleecy/full hand
Hand + = softer, somewhat drier, full hand
Hand +− = moderately soft, full hand
Hand − = no softhand effect
Hydrophilicity +++ = excellent
Hydrophilicity ++ = very good
Hydrophilicity + = good
Hydrophilicity +− = moderate
Hydrophilicity − = none
(measured by comparing the time, in seconds, for a drop of water on the textile to disappear into it).

The above results comprehensively illustrate that only the hydrophilic softhand agents according to the invention combine excellent stability with a consistently soft, pleasant hand and good to very good hydrophilicity without impairing the whiteness.

EXAMPLE 2

A) Preparation of Component (1)

The method of Example 1A) is repeated, except that 130 g of dimethylaminopropylamine are used in place of 160 g diethylaminopropylamine.

B) Preparation of the Hydrophilic Softhand Agent

Example 1 B) is repeated, except that the component (1) used therein is replaced by 35 g of the component (1) prepared as described above and the polyethylene wax dispersion described in Example 1 B) is replaced by 250 g of a nonionic, finely divided aqueous 21% strength polyethylene wax dispersion (25% of tallow fatty amine ethoxylated with 8 moles of ethylene oxide, based on polyethylene wax, as emulsifier; polyethylene wax having a density of 0.93 g/cm$^3$ at 20° C. and an acid/saponification number of about 16).

By the same method it is possible to prepare a softhand agent using 60 g of components (2d) and (2h) in place of the two components (2e1) and (2f).

C) Use of the Hydrophilic Softhand Agent 35 g/l of the dispersion prepared under B) are used in a liquor to finish a lightweight cotton terry towelling cloth (240 g/m$^2$) by dipping, squeezing off to 100% pickup and drying at 120° C. for 10 minutes. The cloth thus treated has a marked soft, fleecy/full hand and, moreover, is very hydrophilic.

EXAMPLE 3

A) Preparation of Component (1)

The method of Example 1 A) is used to prepare the compound 11.12 of DE-A 2,833,172.

B) Preparation of the Hydrophilic Softhand Agent

Using 65 g of the above product (component 1) by the method of Example 1 B) a softhand agent is prepared on the basis of the following polyethylene dispersion: 300 g of a 27% strength polyethylene wax dispersion (polyethylene wax having a density at 20° C. of 0.98 g/cm$^3$, an acid number of 25 and a saponification number of 50; 50% based on polyethylene wax of an emulsifier mixture of a C 16/18-fatty alcohol ethoxylated with on average 40 moles of ethylene oxide per mole of alcohol and emulsifier as described in Example 1 of U.S. Pat. No. 3,904,661 in a ratio of 1:9) with the corresponding reduced amount of water.

C) Use of the Hydrophilic Softhand Agent

Cotton jersey (285 g/m$^2$) is treated at 40° C. by the exhaust method in a liquor ratio of 30:1 (volume:-weight) with a liquor which contains 3% of the softhand agent prepared as described above (duration 30 minutes). The cloth is then briefly whizzed and dried at 110° C.

The cotton jersey finished in this manner is notable for a soft, fleecy hand, good hydrophilicity and good retention of whiteness.

We claim:

1. A hydrophilic softhand agent for fibrous materials, comprising (1) a water-soluble ammonium salt which has at least one saturated or unsaturated $C_9$ to $C_{24}$ fatty acid radical and has been quaternized with a di-$C_1$-$C_2$-alkyl ester of a $C_1$-$C_2$-alkylphosphonic acid, (2) at least one further quaternary ammonium compound other than component (1), having at least one long-chain, saturated or unsaturated alkyl radical of 12 to 24 carbon atoms, and (3) a dispersed emulsifiable polyethylene wax having an acid number of 5 to 115 and a saponification number of 15 to 150, said polyethylene wax being an emulsifiable polyethylene with carboxylic acid functional groups which may be partially esterified.

2. A softhand agent as claimed in claim 1, wherein component (1) has the formula (1)

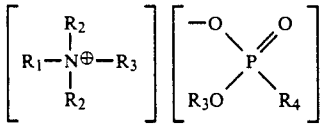

(1)

where $R_1$ is the radical

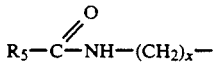

where $R_5$ is saturated or unsaturated $C_{12}$-$C_{22}$-alkyl wherein by weight 75 to 100% of the $R_5$ radicals are saturated and 0 to 25% of the $R_5$ radicals are unsaturated, and x is from 2 to 4, $R_2$ is $C_1$-$C_4$-alkyl and $R_3$ and $R_4$ are each independently of the other $C_1$-$C_2$-alkyl.

3. A softhand agent as claimed in claim 2, wherein R5 is saturated $C_{16}$-$C_{22}$-alkyl, x is 3, R2 is $C_1$-$C_2$-alkyl and R3 and R4 ar $CH_3$.

4. A softhand agent as claimed in claim 1, wherein component (2) is a quaternary compound having at least one saturated and/or unsaturated alkyl radical of at least 12 carbon atoms.

5. A softhand agent as claimed in claim 1, wherein component (2) is a quaternary imidazolinium derivative.

6. A softhand agent as claimed in claim 1, wherein component (2) is a quaternary ammonium derivative.

7. A softhand agent as claimed in claim 1, wherein component (3) is polyethylene wax having a density of 0.95 to 1.05 g/cm$^3$, an acid number of 10 to 60 and a saponification number of 15 to 80, in dispersed form.

8. A softhand agent as claimed in claim 1, comprising in addition customary emulsifiers, known ingredients and water.

9. A softhand agent as claimed in claim 1, comprising in addition water wherein component (1) accounts for 2 to 10% by weight, component (2) accounts for 1 to 13% by weight and component (3) accounts for 2 to 10% by weight, the total amount for all ingredients being 100% by weight.

10. A softhand agent as claimed in claim 8, containing an organopolysiloxane or a fatty acid dialkanolamide as a known ingredient.

11. A method for treating fibre materials, which comprises applying to said material a softhand agent as claimed in claim 1 by padding or by the exhaust method.

12. A method as claimed in claim 11 for the softening and hydrophilizing finishing of cotton terry towelling by padding.

13. A softhand agent of claim 10 comprising an organopolysiloxane which is an epoxy-substituted dimethylpolysiloxane, an organopolysiloxane which is an epoxy-substituted dimethylpolysiloxane, a polyethoxy-, polypropoxy- or polyethoxy/propoxy-substituted dimethylpolysiloxane or an epoxy-substituted dimethylpolysiloxane which is further substituted by polyethoxy, polypropoxy or polyethoxy/propoxy.

14. A softhand agent of claim 13 comprising an epoxy-substituted dimethylpolysiloxane which is further substituted by polyethoxy, polypropoxy or polyethoxy/propoxy.

* * * * *